US006131309A

United States Patent [19]

Walsh

[11] Patent Number: 6,131,309

[45] Date of Patent: Oct. 17, 2000

[54] SHOCK-ABSORBING RUNNING SHOE

[76] Inventor: John Walsh, 26 E. 45th St., Bayonne, N.J. 07002

[21] Appl. No.: 09/090,518

[22] Filed: Jun. 4, 1998

[51] Int. Cl.[7] ..... A43B 13/18; A43B 13/28

[52] U.S. Cl. ..... 36/28; 36/27; 36/7.8; 36/37

[58] Field of Search ..... 36/27, 28, 7.8, 36/35 R, 37, 38, 114

[56] References Cited

U.S. PATENT DOCUMENTS

| | | | |
|---|---|---|---|
| 2,555,654 | 6/1951 | Ostrom | 36/38 |
| 3,886,674 | 6/1975 | Pavia | 36/38 |
| 4,492,046 | 1/1985 | Kosova | 36/27 |
| 4,546,555 | 10/1985 | Spademan | 36/28 |
| 4,756,095 | 7/1988 | Lakie | 36/2.6 |
| 5,187,883 | 2/1993 | Penney | 36/27 |
| 5,311,678 | 5/1994 | Spademan | 36/28 |
| 5,396,718 | 3/1995 | Schuler et al. | 36/38 |
| 5,435,079 | 7/1995 | Gallegos | 36/38 |
| 5,502,901 | 4/1996 | Brown | 36/28 |
| 5,544,431 | 8/1996 | Dixon | 36/38 |
| 5,577,334 | 11/1996 | Park | 36/28 |

FOREIGN PATENT DOCUMENTS

| | | |
|---|---|---|
| 1528431 | 7/1987 | U.S.S.R. . |
| 11896 | of 1909 | United Kingdom . |

*Primary Examiner*—M. D. Patterson

[57] ABSTRACT

A shock-absorbing running shoe has a sole attached to an upper, with a carriage in the upper adapted to receive the rear portion of a runner's foot. The sole has a collapsible area below the carriage. A first strut is attached to the instep side of the sole and extends above the carriage, and a second strut is attached to the outstep side of the sole and extends above the carriage. Elastic bands are coupled to the struts and to the carriage so that the carriage is suspended by the bands over the collapsible area of the sole.

26 Claims, 8 Drawing Sheets

SHOCK-ABSORBING RUNNING SHOE

FIELD OF INVENTION

This device relates to an athletic shoe, and, more particularly, to a shock absorbing running shoe.

BACKGROUND OF INVENTION

It is well known that runners are subjected to sever impacts upon foot strike. This can lead to trauma to the lower extremities, such as to the shin and foot, as well as to upper body parts, such as to the back.

In an attempt to lessen this trauma, many running shoes have been developed that have limited shock absorbency.

For example, it is known to use closed or open fluid-filled chambers, e.g., air or gel, in the sole of a running shoe. As a runner steps, the fluid compresses or is released from the chamber, which provides some cushioning to the runner. The amount of cushioning, however, is proportional to the amount of fluid contained in the chamber. For increased cushioning, the chamber must be made larger, and thus the clearance between the foot and sole must be increased. This decreases the stability of the shoe, particularly in the lateral direction, which can actually increase the likelihood of lower extremity injuries, such as shin splits. Thus, fluid-filled running shoes may not decrease trauma.

Moreover, running shoes with closed fluid-chambers do not significantly reduce the shock associated with foot strike. As a runner's foot strikes the ground, the fluid in these chambers compresses and firms up. This produces a shock to the runner as he or she steps. In addition, it is difficult to predict how much fluid pressure should be pre-filled in a chamber since one runner may be heavier or lighter than another runner. For example, for a lighter runner, the fluid will not sufficiently compress, and, therefore, will not provide much shock absorbency. On the other hand, for a heavy runner, the fluid may compress too much and the chamber may bottom out. Bottoming out may also occur because some runners are more aggressive or run faster that others, which can also lead to over-compression of the fluid in the chambers. Thus, it is difficult to design an inexpensive and reliable fluid chamber running shoe that reduces shocks for runners of different weights and running styles. Moreover, most manufacturers design and pre-fill such fluid chamber runner shoes for the average user, which means that the shoes do not provide sufficient cushioning for lightweight, heavyset or aggressive runners.

Other known designs use springs under the heel to provide cushioning as a runner steps. Springs, however, suffer from similar problems as fluid chambers in that it is difficult to install a spring that will provide adequate cushioning for runners of different weights and running styles. This is because springs under the heel, like fluid that compresses within a chamber, also compress and firm up, and thus may shock the runner. In addition, a spring, like fluid, needs clearance in which to compress, and, the space that the springs and chambers take up in the sole further reduces this clearance.

To increase cushioning, the clearance between the foot and sole must be increased, which decreases the stability of the shoe. Moreover, since different runners have different weights and different running styles, it is difficult to design a spring that is suitable for all runners.

Moreover, known devices fail to provide shock absorption throughout the full range of a runners step. More particularly, as a runners foot strikes the ground, the lower edge of the shoe strikes the ground first. As the shoe contacts the ground, the runners body weight, which has a forward and downward momentum, is forced against the lower heel of the shoe as the runner's foot suddenly decelerates. This force must be adequately cushioned to prevent a shock or jar to the runner.

After the initial impact, the lower leg then rotates over the shoe relative to the ground, and the runner rotates his body weight over the shoe. It is also important to provide cushioning in this range because, as the runner moves over the shoe, body weight is being transferred to the shoe. As the stride continues, the leg continues to rotate, and the forefoot strikes the ground. By the time the forefoot strikes the ground, most of the impact associated with the stride has already been absorbed by the runner.

Known devices, however, fail to provide adequate cushioning during the entire range of heel strike to forefoot strike. More particularly, known devices typically provide cushioning in a strict vertical range of movement. In other words, during cushioning, the rear part of the foot is allowed to move perpendicular to the sole, but not forward, rearward, or inside or out relative to the sole. The runner's body weight, however, is rarely positioned perpendicular to the sole. Consequently, if the foot applies a force in a direction other than perpendicular to the sole, this force may not be adequately cushioned, and the shoe may therefore cause a shock to the body. These shocks, caused by failure to provide a multi-directional range of cushioning, can cause trauma.

A full range of cushioning is particularly important for runners, because a runner's stride constantly changes with speed, distance, change of running surface, and the like. This, in turn, constantly changes the angle between the shoe and leg at impact, the leg's range of rotation, body weight positioning, and the like. Consequently, it is desirable that a running shoe supply cushioning and shock absorption from heel impact until at least forefoot impact (throughout leg rotation), regardless of these changing parameters.

Moreover, during the transition between initial foot strike and forefoot strike, the runner's foot pronates. This is a normal occurrence that allows the foot to act as a natural shock-absorber. The feet of many runner's, however, have abnormal pronation (over or under pronation) which can cause trauma, such as shin splints. Most abnormal pronation problems are due to over pronation, which, in many instances, is caused by flat feet. Under pronation, on the other hand, is usually caused by high arches. In either case, the body's natural shock absorption is reduced, which can lead to trauma. Consequently, there is a need to place a runner's foot in a neutral position in a shoe, which reduces abnormal pronation problems.

People with abnormal pronation, however, have walked and run for years with their feet in non-neutral positions. Forcing such a runner's foot into a neutral position without any transition period can actually cause discomfort and trauma. Consequently, there is a need to correct for abnormal pronation, and also a need to correct for abnormal pronation over a period of time to allow for transition of foot placement.

SUMMARY OF THE INVENTION

The present invention provides a running shoe that suspends a runner's heel from the shoe's sole. More particularly, elastic suspends a heel carriage within the shoe via a frame that is attached to the sole. This provides for a large clearance area under the rear portion of the foot, and thus a greater range of shock-absorption. In addition, the elastic suspension allows the foot to move in a wide range of directions—vertically, horizontally and sideways, or any combination of these directions. This translates into a wide range of shock-absorption for the runner in all of these directions throughout the entire stride, which significantly reduces the shocks associated with running. The elastic is preferably adjustable in flex so as to vary the shock absorbency of the shoe and to canter the heel carriage.

BRIEF DESCRIPTION OF THE DRAWINGS

The accompanying drawings, which are incorporated in and constitute part of the specification, illustrate a presently preferred embodiment of the invention, and, together with the general description given above and the detailed description of the preferred embodiment given below, serve to explain the principals of the invention.

DETAILED DESCRIPTION OF THE PREFERRED EMBODIMENT

Figure 1:
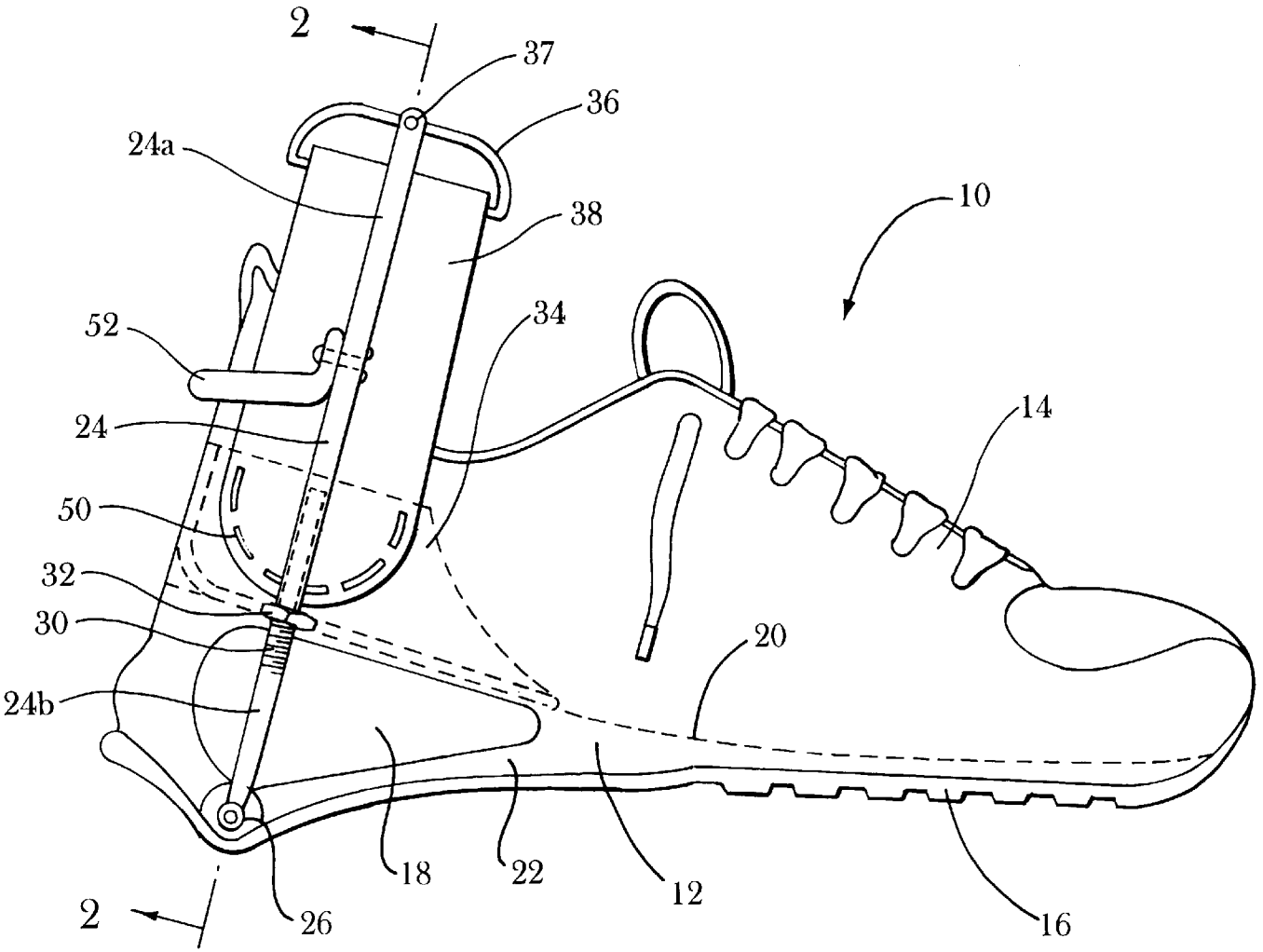
FIG. 1 is a side view of the preferred embodiment of a shock-absorbing running shoe of the present invention.

Turning to FIG. 1, a side view of the shock-absorbing running shoe of a first embodiment is shown generally at 10. This is a side-view of a running shoe 10 for the right foot of a runner, as shown from the right side or lateral side of the shoe 10. The shoe 10 comprises a sole 12 attached to an upper 14. An impact surface 16 may be attached to the sole 12 for additional grip and durability.

The upper 14 is adapted to contain a runner's foot, which is supported by the upper surface of the sole 12, shown generally at 20. Of course, an insert, insole or the like (not shown) can be placed on the upper surface 20 under the foot to provide for additional comfort, fit, cushioning, etc., as is known in the art.

The sole 12 has a hollow portion 18 that provides a space in which the upper surface 20 of the sole 12 can move relative to the lower portion of the sole 12, shown generally at 22. This, in turn, allows the runner's foot, and, more particularly, the rear portion of the runner's foot, to move relative to the lower sole portion 22, and hence allows the runner's foot to move relative to the running surface during impact.

Figure 2:
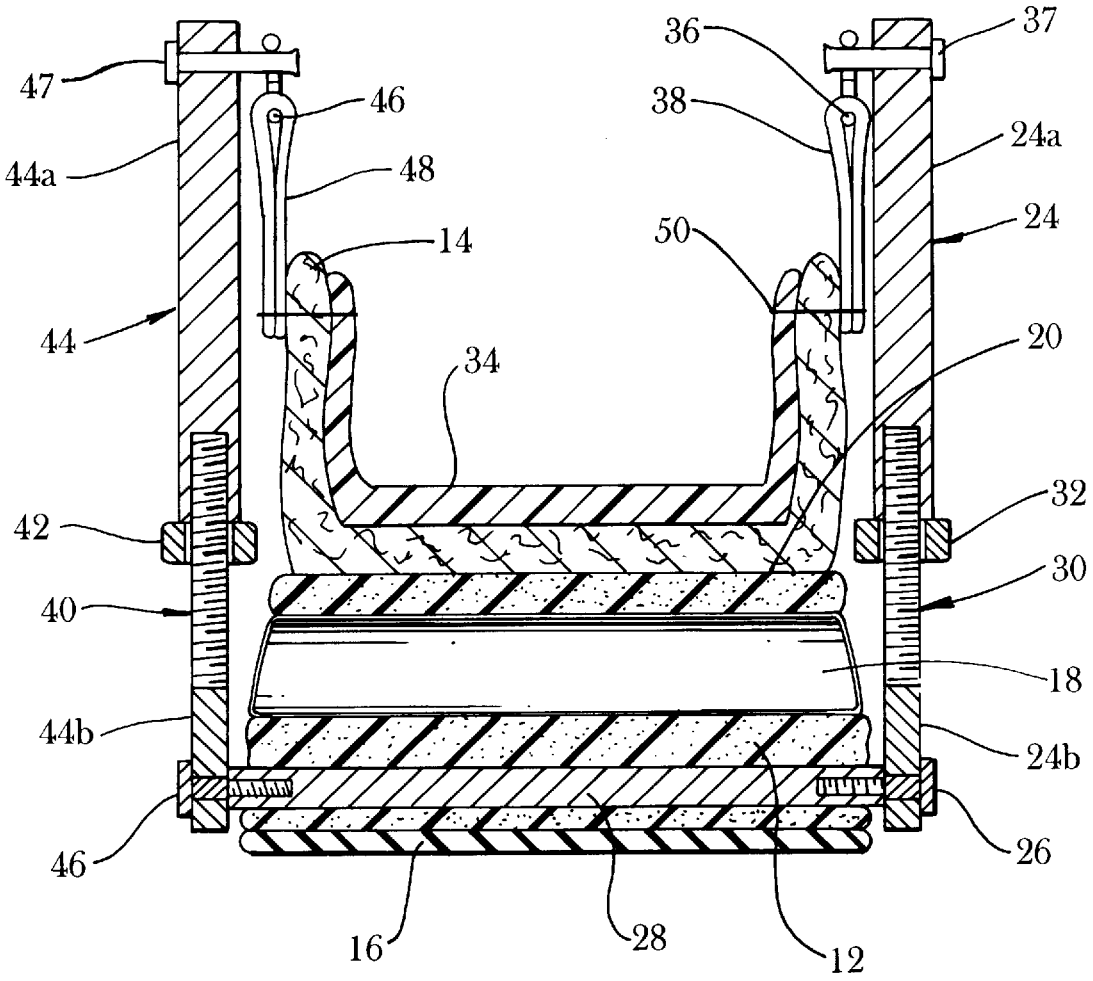
FIG. 2 is a cross sectional view of a shock-absorbing running shoe of the present invention taken along lines 2—2 of FIG. 1.

A first strut 24 is attached to the lower sole portion 22. The strut 24 is attached to the lower sole portion 22 via bolt 26 that is threaded into a threaded rod 28, which is best shown in FIG. 2. Of course, the strut may be attached to the lower sole portion 22 via any suitable manner, such as a screw, glue, fitted into an opening in sole 12, or the like. The strut 24 may be constructed of plastic, metal, composite or the like.

Preferably, the strut 24 is attached to the lower sole portion 22 at a position located roughly under the center of the heel. This way, the strut 24 is well positioned to receive the impact associated with a running step (as explained further below).

A second strut 44 is attached to the other end of the rod 28 via bolt 46 on the other side of the shoe 10, which is also shown in FIG. 2. Rod 28 is preferably inserted through a hollow cylinder bored through the sole 12, and may be fixed with glue. Preferably, strut 44 is positioned at about the same axial location on the lower sole portion 22 as strut 24. Of course, as persons skilled in the art will appreciate, struts 24 or 44 may be attached to the lower sole 22 in any suitable fashion, and rod 28 may be eliminated. Similarly, rod 28, strut 24 and strut 44 can be constructed of or into a single unit, such as a solid piece of plastic, composite or metal, as shown, for example, in FIG. 6A and explained further below.

Preferably, strut 24 consists of a female upper strut member 24*a* and a male lower strut member 24*b*, which has threads 30. The lower strut member 24*b* is inserted into upper strut member 24*a*. A nut 32 is threaded onto lower strut 24*b*. The nut 32 can be threaded upwards or downwards on lower member 24*b*, which raises or lowers upper strut 24*a*, respectively. Consequently, the length of first strut 24 can be selectively made longer or shorter via nut 32.

The upper surface 20 of sole 12 supports a carriage 34, which is best shown in FIG. 2. The carriage 34 can be made from plastic, composite, heavy cloth, or the like. The carriage 34 is adapted to receive the rear portion of a user's foot, and may be lined with material or cushioning for added comfort.

The upper strut 24*a* is attached to a hanger 36 via a rivet 37, bolt, or the like. Alternatively, a hook can be attached to the upper strut 24*a* and the hanger 36 can be hung from the hook. An elastic band 38 is hung from the hanger 36, and is attached to the carriage 34, preferably through the upper 14 via stitching 50, glue, or the like. The elastic band 38 can be a stretchable fabric, rubber, or the like. The elastic band 38 can alternatively be attached to the carriage 34 within the upper 14 instead of through the upper as shown in the Figure. Also, the elastic band 38 and the carriage 34 can be constructed of a single piece of heavy cloth, composite or rubber, or any combination of cloth, plastic, composite, rubber or elastic (not shown).

Turning to FIG. 2, a cross-sectional view of the shoe 10 is shown along lines 2—2 in FIG. 1. The second strut 44 is shown on the medical side of shoe 10. Like strut 24, strut 44 preferably consists of female upper strut member 44*a* and male lower strut member 44*b*, which has threads 40. The lower strut member 44*b* is inserted into upper strut member 44*a*. A nut 42 is threaded onto lower strut 44*b*. The nut 42 can be threaded upwards or downwards on lower strut 44*b*, which raises or lowers upper strut 44*a*, respectively. Consequently, like strut 24, the length of strut 44 can be selectively made longer or shorter via the nut 42.

Like upper strut 24*a*, upper strut 44*a* is attached to a hanger 46 via a rivet 47, bolt or the like. An elastic band 48 is hung from the hanger 46, and is attached to the carriage 34, preferably through the upper 14 via stitching 50 or the like. Like elastic band 38, elastic band 48 is preferably rubber, but can also be stretchable fabric, a combination of fabric or rubber, or the like. As shown in FIG. 1, a tie rod 52 is preferably attached to both struts 24 and 44 for additional support to keep the strut from bowing or cantering. Alternatively, instead of or in addition to tie rod 52, the struts 24 and 44 can be coupled directly to the upper 14 via glue, stitching, fabric, or the like to minimize their movement.

Thus, carriage 34 is suspended from the lower sole 22 via elastic bands 38 and 48. Hence, the rear portion of a user's foot is suspended in the carriage 34 from the lower sole 22 via elastic bands 38 and 48.

Figure 3:
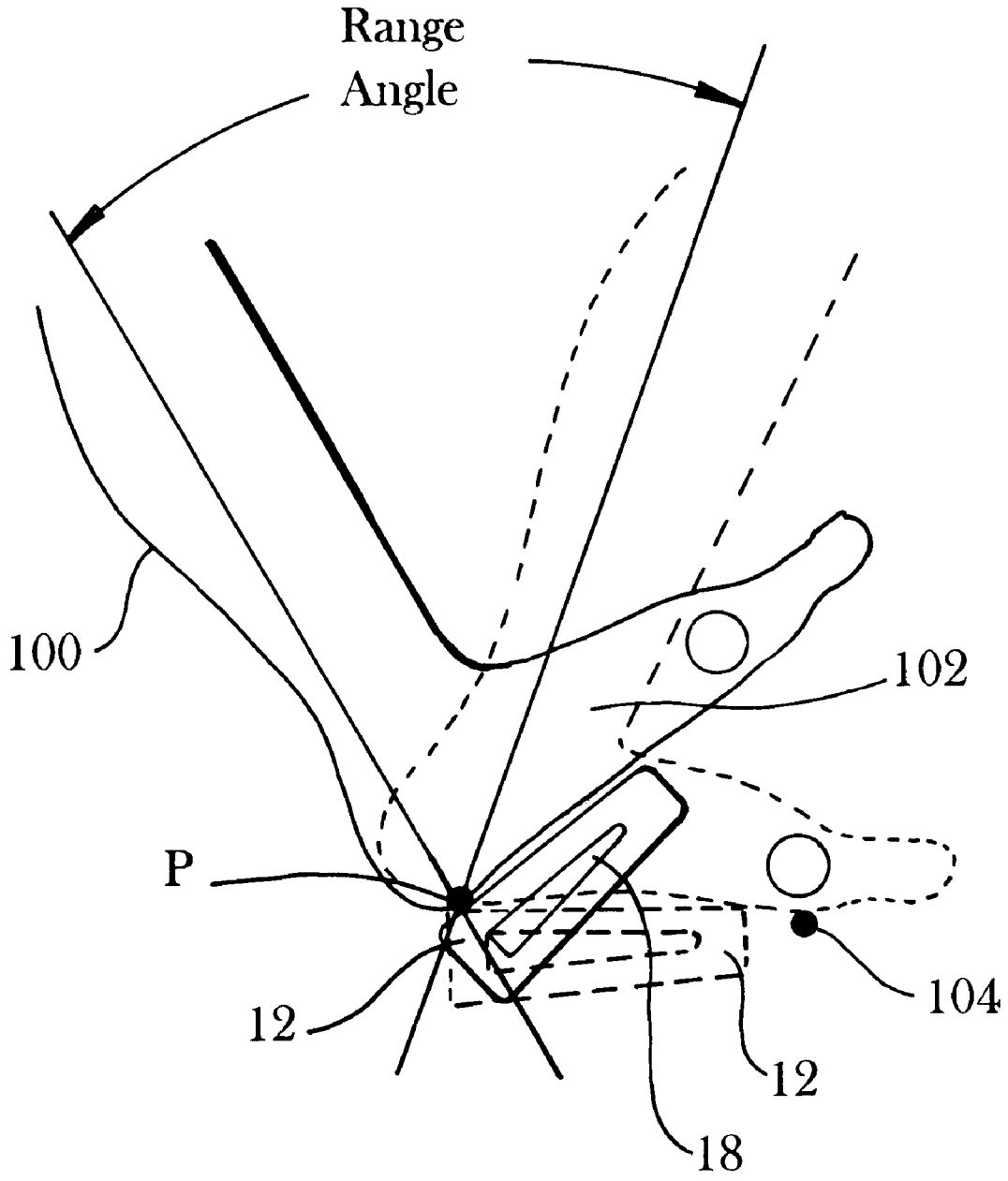
FIG. 3 is a side view of a runner's lower leg and foot along with a partial view of the sole of the preferred embodiment of the shock-absorbing running shoe of the present invention.

Turning to FIG. 3, a side view of a runner's lower leg 100 and foot 102 is shown along with a partial view of sole 12 around hollow portion 18. The solid lines show the runner's lower leg 100 and foot 102 upon initial impact, and the dotted lines show the runner's lower leg 100 and foot 102 when the forefoot impacts, as shown at 104. There is a range angle between the lower leg 100 upon initial impact and the lower leg 100 upon forefoot impact. This range angle will vary with stride, speed, uphill ground, downhill ground, and the like. As explained below, shoe 10 of the present invention provides a full range of shock absorbency for the runner throughout varying range angles.

Figure 4:
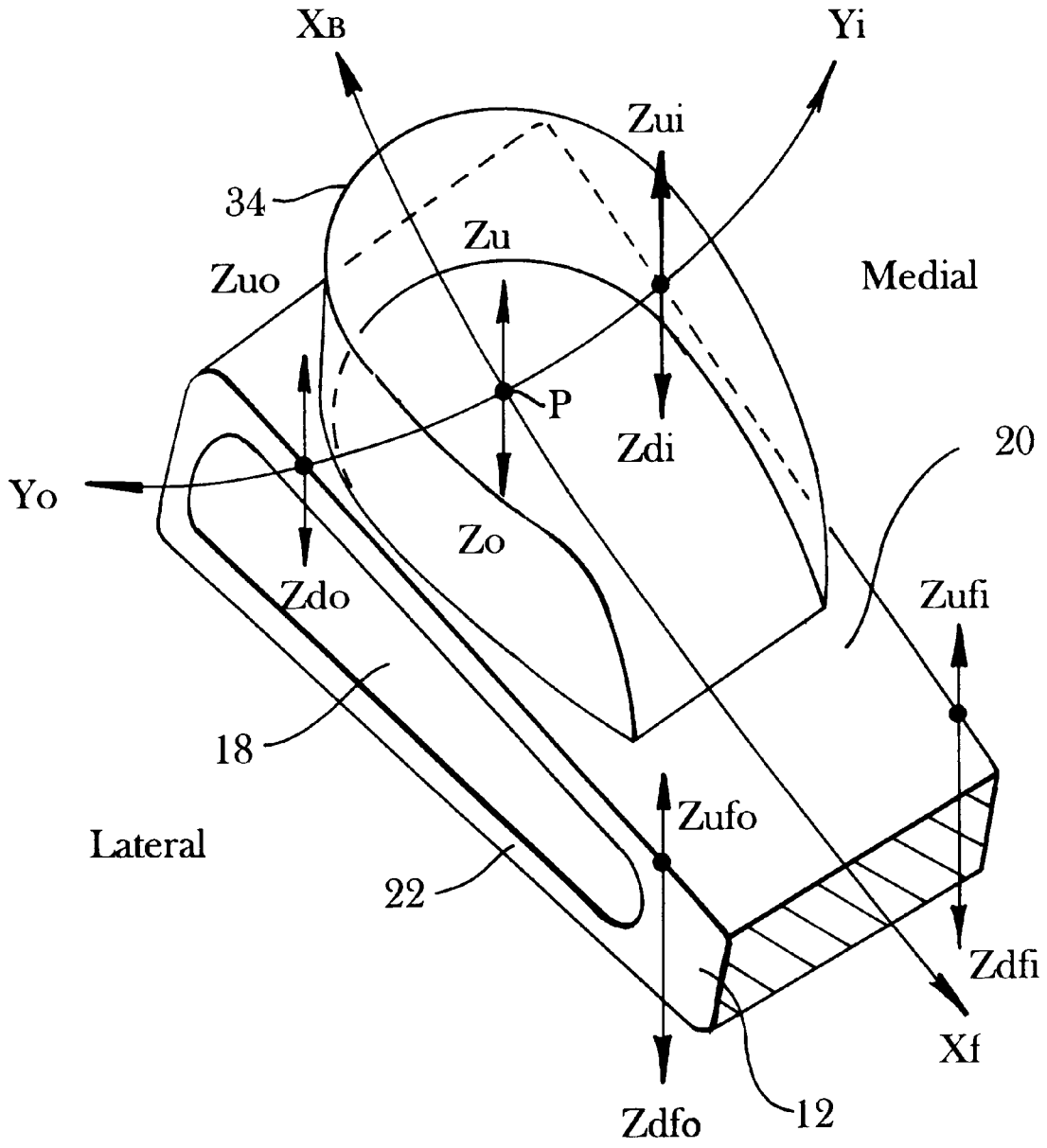
FIG. 4 is a perspective elevational view of the carriage and a partial view of the sole of the preferred embodiment of the shock-absorbing running shoe of the present invention.

More particularly, FIG. 4 shows a perspective elevational view of the carriage 34 and a partial view of sole 12 around the hollow portion 18. As with FIGS. 1, 2 and 3, this arrangement is for the right foot of a runner. Carriage 34 is supported by the upper surface 20 of sole 12. A point P is shown, which represents about where the center of a runner's heel will be positioned. Several axis are shown to illustrate how the suspended runner's foot floats above the hollow portion 18. More particularly, since the runner's foot is suspended above the hollow portion 18 via elastic bands 38 and 48, and since the sole 12 is made of a flexible material, the rear foot can move in any axial direction. For example, the heel of the foot can move up or down about point P, shown by axially directions Zu and Zd. At the same time, the heel of the foot towards the instep can move up or down, which is shown by axial directions Zui and Zdi, respectively. Also, at the same time, the heel of the foot towards the outstep, can similarly move up or down, which is shown by axial directions Zuo and Zdo, respectively.

Meanwhile, the heel can slide slightly forward or back, which is shown by axial directions Xf and Xb. Also, the heel can slide slightly sideways, either towards the medical or towards the lateral, which is shown by axial directions Yi or Yo, respectively. Meanwhile, towards the forefoot, the medical or lateral of the foot can move up or down, shown by axial directions Zufi, Zdfi, Zufo and Zdfo. Of course, the foot can move diagonally in any cross-axial direction as well Consequently, as a runner takes a stride in shoe 10, the shoe 10 first strikes the ground at its lower end. This will cause, for example, hollow portion 18 to partially collapse, and will cause stretching of bands 38 and 48. The upper surface 20 of sole 12 will move downward, shown generally by Zd, Zdo and Zdi in FIG. 4. At the same time, the foot may apply forward pressure to sole 12 causing slight movement in the axial direction Xf. Thus, the initial shock associated with this initial ground strike is significantly reduced, which significantly reduces trauma to the runner.

As the lower leg 100 rotates over the shoe, the foot may pronate, causing additional pressure in the Zdfi direction. As the lower leg continues to rotate, pressure may be released from the Xf direction, and may actually move slightly in the other, Xb direction. Maximum pressure will be applied at some point, (which is typically at or shortly after impact) causing maximum pressure in the Zd, Zdi and Zdo directions. Also, as the leg continues to rotate, more pressure will be applied towards the forefoot (Zfdi and Zfdo), and less pressure is applied in the Zd, Zdi and Zdo directions, which may cause upward movement in the Zu, Zui and Zuo directions. Eventually, there is toe lift, and the bands 38 and 48 relax as weight is removed from the shoe 10. The process then starts again with another stride.

Of course, the above description is an example of one stride, and no two strides are identical, and running surfaces and conditions constantly change. Therefore, other strides may have different foot pressures, causing different axial movements. By suspending the heel via elastic bands, however, sufficient shock-absorption of all of these independent movements can be achieved. In fact, suspension of the heel allows, for each independent stride, the rear portion of the foot to find its ideal location in the shoe 10, while minimizing shocks and significantly reducing trauma.

Moreover, a runner can preferably custom adjust the cushioning and shock absorbency of the shoe 10 by adjusting nuts 32 and 42. By turning nuts 32 or 42, struts 24 and 44 can be made longer or shorter, which will stretch or relax the bands 38 and 48. By stretching the bands, band flexibility will decrease, thereby making the shoe 10 stiffer. This may be appropriate for heavier runners or for more aggressive runners. By relaxing the bands, flexibility will increase, which may be appropriate for lighter or less aggressive runners. Preferably, the user will adjust nuts 32 and 42 such that, for his or her personal running style and weight, point P will move sufficiently downwards for adequate cushioning and shock absorption, but will not bottom out against the lower sole 22.

Moreover, by selectively lengthening or shortening one strut versus another strut, the carriage 34 can be selectively cantered. Consequently, a user can selectively adjust nuts 32 or 42 to canter his or her foot position in shoe 10. Since each runner has a different arch and a different amount of arch pronation during a step, the shoe 10 can be easily custom adjusted for maximum comfort and shock absorbency. By periodically making adjustments to nuts 32 and 42, a user can selectively correct a pronation problem over a period of time. This way, trauma associated with the sudden correction of a pronation problem can be minimized.

Of course, for aesthetic purposes, the struts 24 and 44 and tie rod 52 can be covered in a cloth, leather, or the like (not shown). Preferably, such covering would be removable or have an opening near the nuts 32 and 42 to allow access for adjustment of the nuts and adjustment of elastic bands.

Figure 5B:
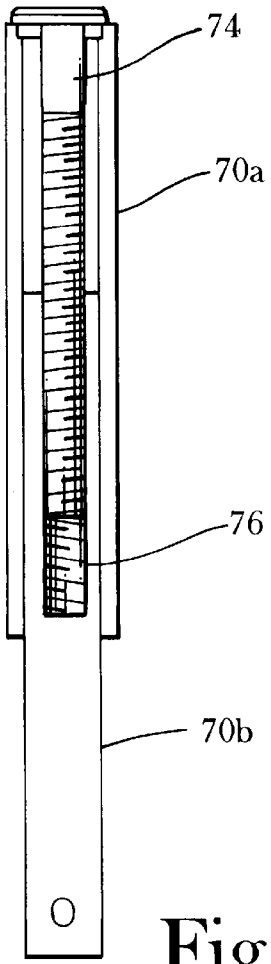
FIG. 5B is a cross-sectional view of the strut of FIG. 5A taken along lines 5B—5B of FIG. 5A.
Figure 5A:
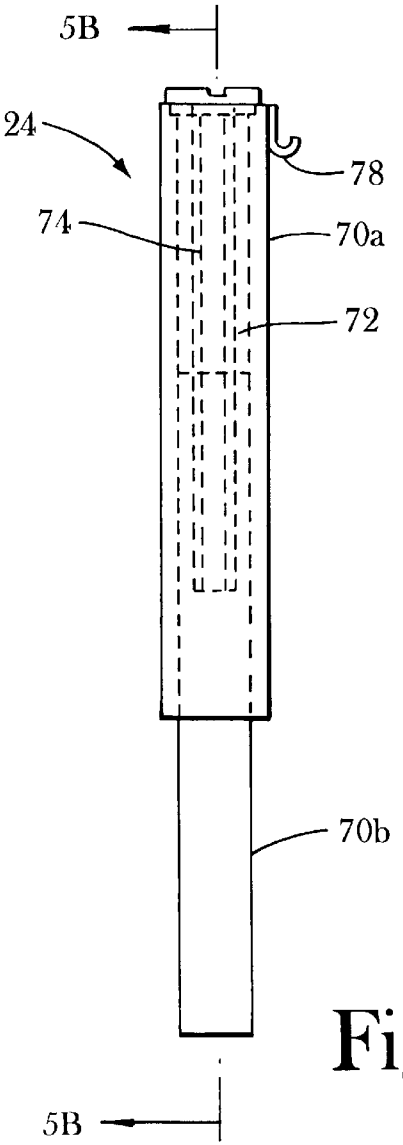
FIG. 5A is a side view of a strut in accordance with an alternative embodiment of the shock absorbing running shoe of the present invention.

An alternative strut structure is shown in FIGS. 5A and 5B. In this embodiment, strut 24 consists of a female upper strut member 70*a* and a male lower strut member 70*b*. The upper strut member 70*a* has a hollow cylindrical portion 72 through which a screw 74 is inserted. The screw 74 is rotatably coupled to the upper strut 70*a* so that it can spin in the strut but cannot move axially. This can be accomplished, for example, by placing a washer, C-clip or the like in a grove in the screw 74, and then fixing the washer to the upper strut 70*a* (not shown). Lower strut member 70*b* has threads 76. The upper strut member 70*a* is inserted over lower strut member 70*b*, and the screw 74 engages the threads 76. The screw 74 can be threaded upwards or downwards on lower member 70*b*, which raises or lowers upper strut 70*a*, respectively. Consequently, the length of the strut 24 can be selectively made longer or shorter via the screw 74. Moreover, struts 24 and 44 can be easily and esthetically covered with cloth, leather or the like, leaving an opening near the head of screw 74 so the user can selectively adjust the length of struts 24 and 44. Hanger 36 (not shown) is supported by a hook 78.

Figure 6A:
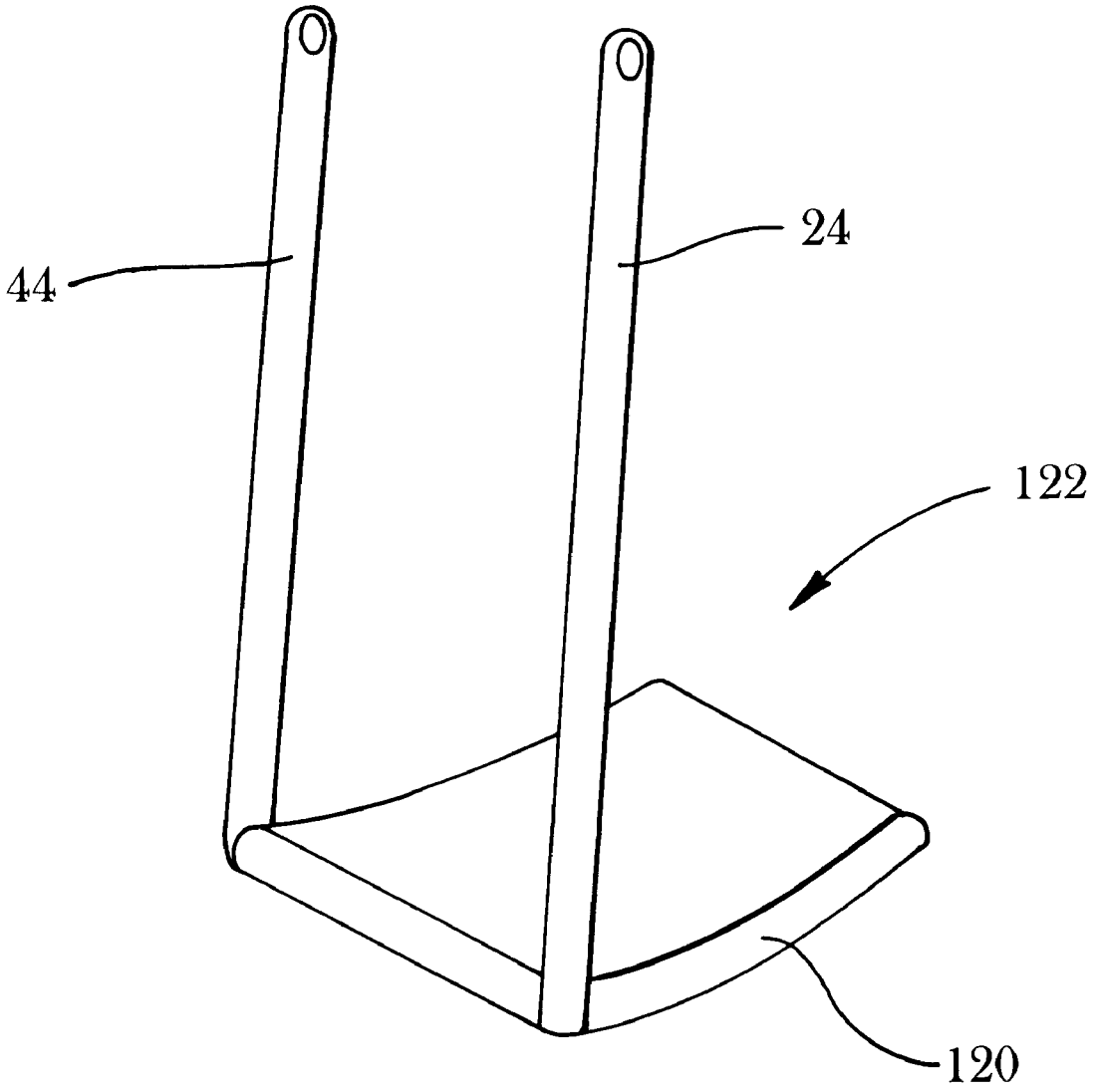
FIG. 6A is a perspective view of a strut support structure in accordance with an alternative embodiment of the shock absorbing running shoe of the present invention.
Figure 6B:
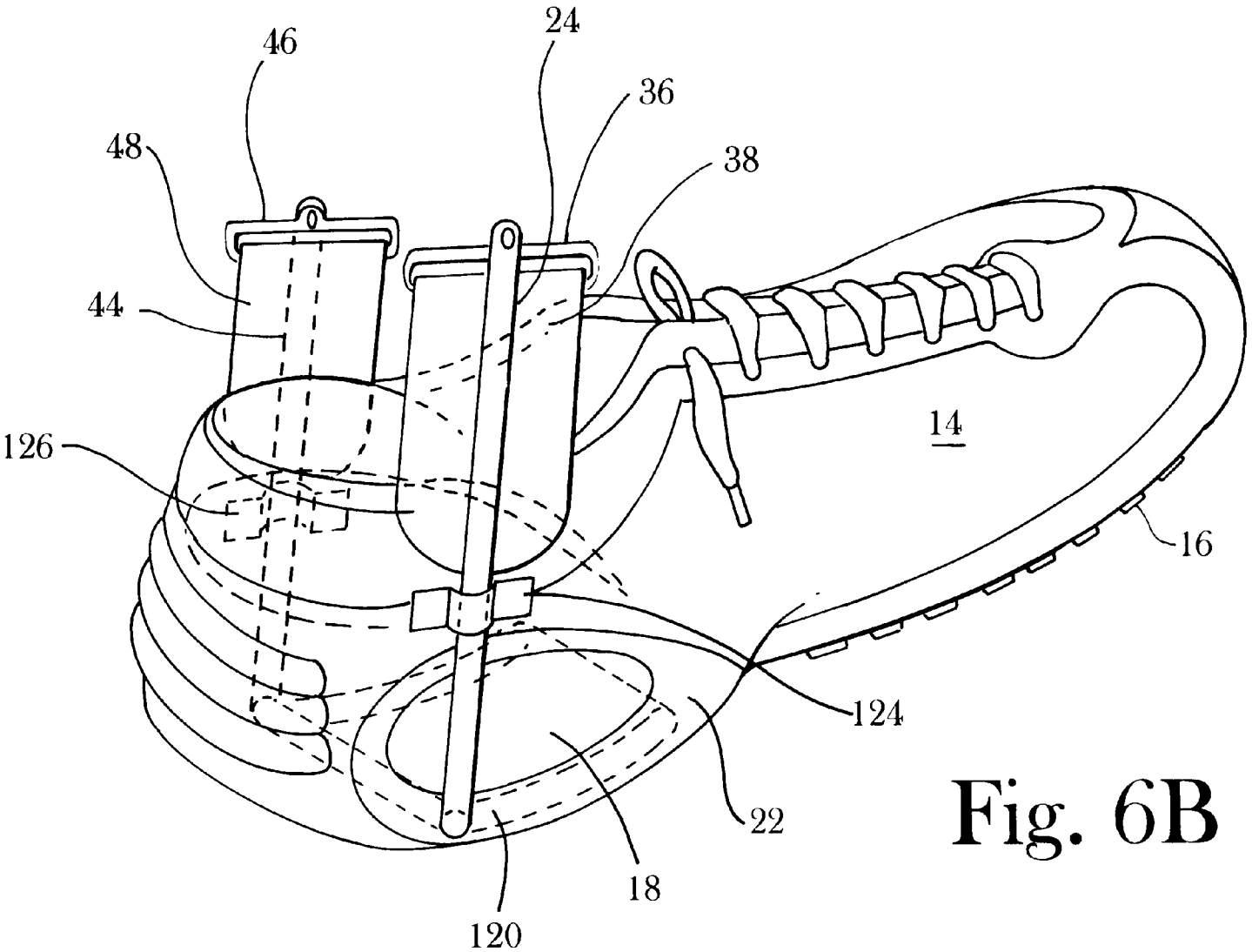
FIG. 6B is an elevational perspective view of an alternative embodiment of the shock absorbing running shoe of the present invention having the strut support structure illustrated in FIG. 6A.

An alternative strut support is shown in FIGS. 6A and 6B. Struts 24 and 44 are coupled to a base 120 that is molded into lower sole 22. The base 120 provides support for the struts 24 and 44 and also disperses the physical stresses along sole 22 that are associated with impact. This reduces the wear on the sole by minimizing stress points. Base 120 and struts 24 and 44 may be, for example, three or more separate pieces joined via bolts or screws, or joined via a male-female arrangement with glue or the like. Alternatively, base 120 and struts 24 and 44 may be a single piece that is molded into the sole 22 (as shown). In other words, base 120, strut 24 and strut 44 can comprise a frame structure 122 that supports hangers 36 and 46, which, in turn, support the elastic bands 38 and 48. The struts 24 and 44 of frame 122 can be esthetically covered within the lining of upper 14 (not shown). Also, as shown in FIG. 6B, tie rod 52 is replaced with individual straps 124 and 126 that hold the struts 24 and 44 to the upper 14. Of course, as persons skilled in the art will appreciate, if the struts 24 and 44 are attached to, or are part of, a sufficient base 120, this frame structure 122 may itself provide adequate support for struts 24 and 44, which may eliminate the need for tie rod 52, straps 124 and 126 or the like.

Figure 7B:
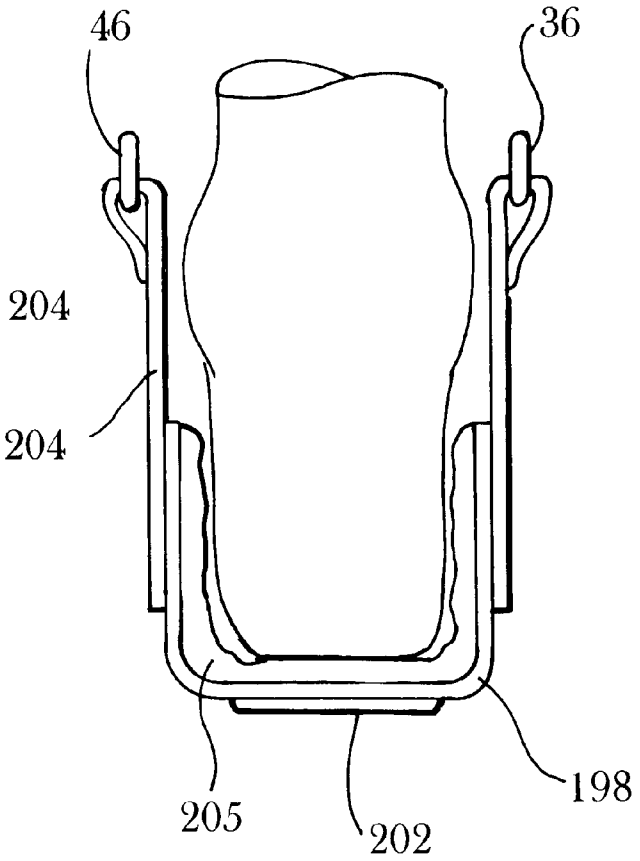
FIG. 7B is a rear view of a runner's foot along with the carriage illustrated in FIG. 7A in accordance with an alternative embodiment of the present invention.
Figure 7A:
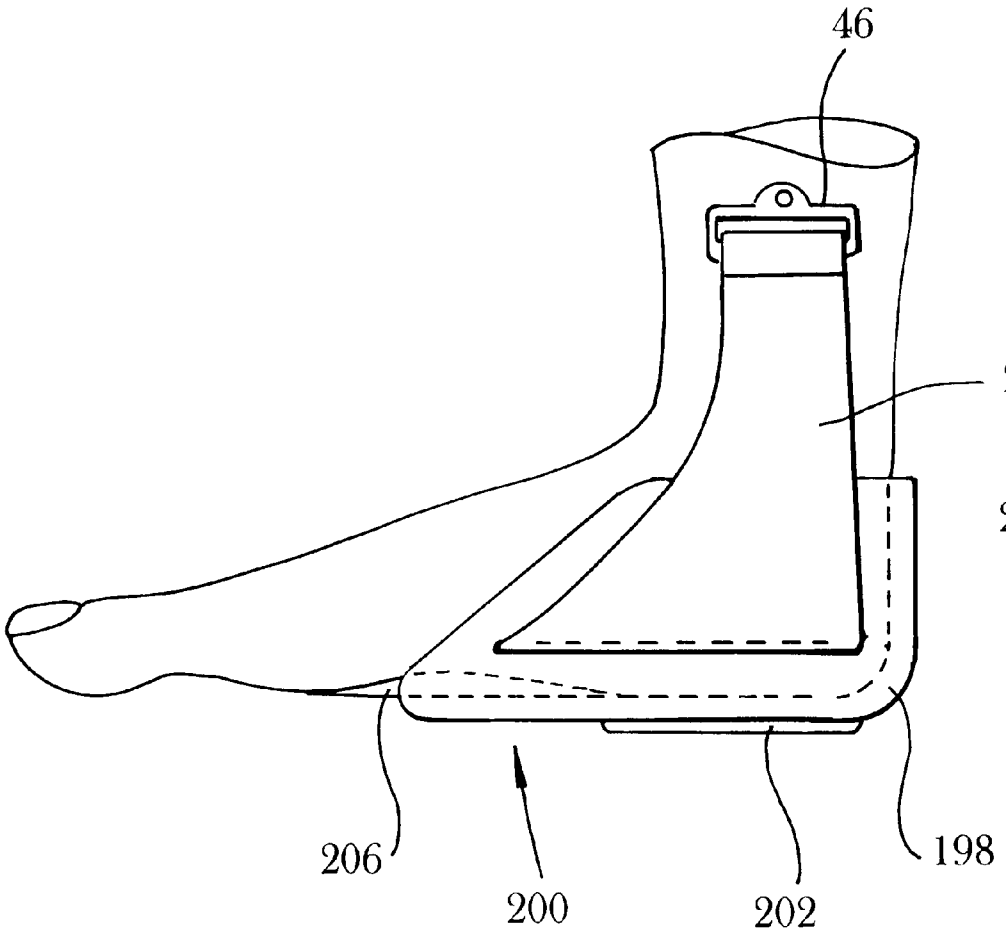
FIG. 7A is a side view of a runner's foot along with a carriage in accordance with an alternative embodiment of the shock absorbing running shoe of the present invention.

An alternative carriage structure is shown in FIGS. 7A and 7B. The carriage 34 is replaced with a slightly elongated carriage 198 so that it supports the arch area of the foot, shown generally at 200. Elastic band 204 is attached to the carriage 198 via any suitable means such as stitching or glue. The elastic band 204 is widened in the carriage area so that the elastic supports the carriage 198 in the arch area 200. Consequently, the arch of the foot is supported and suspended from the lower sole 22 via carriage 198, elastic band 204, hanger 46 and strut 44. This arrangement provides additional support for the arch of the foot, which can further reduce the trauma associated, for example, with flat feet (over pronation) or high arches (under pronation). Since the elastic 204 is preferably adjustable in tension via an adjustment in the length of strut 24 (as described in detail above), the amount of arch support can be selectively adjusted to the user's individual requirements.

An optional resilient support 202, which can be plastic, for example, is shown under the elongated carriage 198 to provide further support for the carriage under the heel. Preferably, the elongated carriage 198 is made out of a pliable material such as leather or heavy cloth so that it will fit snugly against the foot thereby "hugging" the foot when weight is applied. This provides good support and minimizes slipping between the foot and the carriage 198. This cradling effect is illustrated in FIG. 7B. Resilient support 202 provides a support surface for the foot if the carriage 198 is sufficiently pliable.

Optional padding 205 is also shown in the carriage 198. The padding 205 allows for a closer and more comfortable fit between the foot and the elongated carriage 198. Similarly, the padding 205 can comprise an arch support 206. Alternatively, the arch support 206 can be built into the carriage 198, or can be an insert placed on top of the carriage 198 or under or over the padding 205.

While the preferred embodiments of the invention have been illustrated and described, it will be appreciated that other changes can me made therein without departing from the spirit or scope of the invention. Accordingly, it is not intended that the present invention in any way be limited by the specification, but instead, that the scope of the invention be entirely determined by reference to the claims that follow.

What I claim is:

1. A shock absorbing running shoe comprising:

a shell for receiving a runner's foot;

an outer sole coupled to said shell for contacting a ground surface;

an inner sole for supporting at least the heel portion of said foot that is displaceable in at least two axial directions relative to said outer sole;

at least one support member having a proximal end and a distal end, said proximal end coupled to said outer sole, and said support member extending substantially perpendicularly from said outer sole; and elastic coupled to said distal end of said at least one support and to said inner sole for elastically supporting said inner sole above said outer sole.

2. The shoe of claim 1 wherein said at least one support comprises:

a first support having its proximal end coupled to the medial side of said outer sole; and a second support having its proximal end coupled to the lateral side of said outer sole.

3. The shoe of claim 1 wherein said elastic comprises:

a first elastic having a distal end coupled to said distal end of said first support and a proximal end coupled to the medial side of said inner sole for elastically supporting the medial side of said inner sole above said outer sole; and a second elastic having a distal end coupled to said distal end of said second support and a proximal end coupled to the lateral side of said inner sole for elastically supporting the lateral side of said inner sole above said outer sole.

4. The shoe of claim 3 wherein said first support has first means for adjusting the length of said first support and said second support has second means for adjusting the length of said second support.

5. The shoe of claim 3 wherein said first and second elastics comprise rubber.

6. The shoe of claim 1 wherein said at least one support member comprises a substantially U-shaped frame for extending about said heel portion of said foot.

7. The shoe of claim 6 wherein said elastic comprises:

a first elastic having a distal end coupled to the medial side of said distal end of said frame, and a proximal end coupled to the medial side of said inner sole, for elastically supporting the medial side of said inner sole above said outer sole; and a second elastic having a distal end coupled to the lateral side of said distal end of said frame, and a proximal end coupled to the lateral side of said inner sole, for elastically supporting the lateral side of said inner sole above said outer sole.

8. The shoe of claim 1 wherein said at least one support member extends substantially perpendicularly from said outer sole and protrudes above said shell.

9. The shoe of claim 1 wherein said inner sole comprises a heel carriage.

10. The shoe of claim 9 wherein said at least one support comprises:

a first support having its proximal end coupled to the medial side of said outer sole; and a second support having its proximal end coupled to the lateral side of said outer sole;

and wherein said elastic comprises:

a first elastic having a distal end coupled to said distal end of said first support and a proximal end coupled to the medial side of said heel carriage for elastically supporting the medial side of said heel carriage above said outer sole; and a second elastic having a distal end coupled to said distal end of said second support and a proximal end coupled to the lateral side of said heel carriage for elastically supporting the lateral side of said heel carriage above said outer sole.

11. A running shoe comprising:

a sole having a medial portion, a lateral portion and a collapsible portion;

a heel carriage having a medial portion and a lateral portion for supporting at least the heel portion of a foot, said carriage positioned at least partially above the collapsible portion of the sole;

a first support member having a proximal end and a distal end extending substantially perpendicularly from said medial portion of said sole;

a second support member having a proximal end and a distal end extending substantially perpendicularly from said lateral portion of said sole;

a first elastic having a proximal end coupled to said medial portion of said carriage and a distal end coupled to said distal end of said first support member;

a second elastic having a proximal end coupled to said lateral portion of said carriage and a distal end coupled to said distal end of said second support member;

said carriage is elastically supported above said collapsible portion of said sole.

12. The shoe of claim 11 wherein said sole has a lower portion under said collapsible portion, and said proximal ends of said first and second support members are coupled to said lower portion of said sole.

13. The shoe of claim 12 further comprising a third support member coupling said first support member to said second support member.

14. The shoe of claim 13 wherein said first, second and third support members comprise a frame structure extending substantially around said heel portion of said foot.

15. The shoe of claim 12 wherein said first or second support member has means for adjusting the length of said support.

16. The shoe of claim 12 wherein said first and second support members have means for adjusting the length of said supports.

17. The shoe of claim 11 wherein said heel carriage is adapted to support the arch area of said foot.

18. The shoe of claim 17 wherein at least a portion of said first elastic is coupled to said heel carriage in said arch support area to elastically support said arch of said foot.

19. The shoe of claim 17 wherein said first and second elastics comprise rubber.

20. A running shoe comprising:

a sole having an upper portion, a lower portion, a medial portion, a lateral portion and a collapsible portion between said upper and lower portions;

a heel carriage for supporting at least the heel portion of a foot, said heel carriage having a medial portion and a lateral portion, and said carriage positioned above said upper portion of said sole at least partially above the collapsible portion of the sole, and said heel carriage displaceable into said collapsible portion of said sole in at least two axial directions;

a first support member having a proximal end supported by said lower portion of said sole and a distal end extending above said upper portion of said sole, a second support member having a proximal end supported by said lower portion of said sole and distal end extending above said upper portion of said sole, a first elastic having a proximal end coupled to said medial portion of said heel carriage and a distal end coupled to said distal end of said first support member;

a second elastic having a proximal end coupled to said lateral portion of said heel carriage and a distal end coupled to said distal end of said second support member.

21. The shoe of claim 20 wherein said first and second support members are coupled together, forming a frame structure.

22. The shoe of claim 20 wherein said first or second support member has length adjustment means to adjust the length of said support member to canter said heel carriage.

23. The shoe of claim 20 wherein said first or second support member has length adjustment means to adjust the length of said support member to vary the flex of said first or second elastic.

24. The shoe of claim 20 wherein said first and second support members have length adjustment means to adjust the length of said support members to canter said heel carriage.

25. The shoe of claim 20 wherein said first and second support members have length adjustment means to adjust the length of said support members to vary the flex of said first and second elastics.

26. The shoe of claim 20 wherein said first and second elastics comprise rubber.

* * * * *